US007401365B2

(12) United States Patent
Neal et al.

(10) Patent No.: US 7,401,365 B2
(45) Date of Patent: Jul. 22, 2008

(54) EMERGENCY INFORMATION SYSTEM FOR SAFETY HELMETS

(75) Inventors: Gary Neal, 19 Cochrane Lake Trail, Cochrane, Alberta (CA) T4C 2A8; Sarah Margaret Neal, Cochrane (CA)

(73) Assignee: Gary Neal, Nanaimo, British Columbia (CA)

( * ) Notice: Subject to any disclaimer, the term of this patent is extended or adjusted under 35 U.S.C. 154(b) by 16 days.

(21) Appl. No.: 11/278,704

(22) Filed: Apr. 5, 2006

(65) Prior Publication Data

US 2007/0245465 A1 Oct. 25, 2007

(51) Int. Cl.
*A42B 1/24* (2006.01)

(52) U.S. Cl. ..... 2/209.13; 40/329

(58) Field of Classification Search ..... 40/329
See application file for complete search history.

(56) References Cited

U.S. PATENT DOCUMENTS 5,628,065 A * 5/1997 Austin ..... 2/81
5,687,496 A * 11/1997 McEnroe ..... 40/329
5,743,621 A * 4/1998 Mantha et al. ..... 362/105
5,915,539 A * 6/1999 Lack ..... 2/422
6,718,559 B1 * 4/2004 Davidson ..... 2/422
6,751,805 B1 * 6/2004 Austion ..... 2/94

* cited by examiner

*Primary Examiner*—Katherine Moran

(57) ABSTRACT

An emergency information system for a helmet for providing first attenders, paramedics and police emergency with emergency contact and medical information in the event a user is involved in an accident. The emergency information system includes an information carrier attachable to or inserted into a safety helmet. The information carrier can be a waterproof information card or an electronic information carrier, such as flash-memory device. With the use of an electronic information carrier a computer system is available to either read or write emergency contact and medical information or other such information to the carrier. The emergency information system further can include reflective elements to increase visibility of the wearer to other road users in low-light conditions.

1 Claim, 5 Drawing Sheets

EMERGENCY INFORMATION SYSTEM FOR SAFETY HELMETS

BACKGROUND OF THE INVENTION

Field of the Invention

The present invention relates generally to personal medical information carriers for aiding emergency or medical personnel in the treating of a person bearing the medical information carrier. More particularly, relating to a personal medical information carrier for a safety helmet which can be easily accessed to quickly gain the medical information.

SUMMARY OF THE INVENTION

In accordance with the present invention, an emergency information system for a helmet is provided. The primary purpose of the emergency information system is to provide emergency services with emergency contact and medical information in the event the user is involved in an accident. A secondary purpose is to provide a reflective element to the wearers helmet allowing them to be better seen by other road users in low-light conditions.

In general, in one aspect, the emergency information system for a helmet includes a sleeve having an open end and being affixable to an exterior surface of a helmet; an information card of dimensions such that said information card is removably slidable into and out of the sleeve through the open end, the information card being water proof and bearing emergency medical and contact information; and a decal affixable to an exterior surface of the helmet, the decal bearing indicia indicating the information card is available and a wanting, such as "Do not remove helmet until examined by EMS".

In general, in another aspect, the emergency information system for a helmet includes a helmet; an information carrier being removably insertable into the helmet, the information carrier containing emergency medical and contact information; and indicia on an exterior surface of the helmet approximate the location of the information carrier, the indicia indicting the presence of the information carrier.

In general, in another aspect, the emergency information system for a helmet includes a helmet; an information carrier being removably insertable into the helmet, the information carrier containing emergency medical and contact information; indicia on an exterior surface of the helmet approximate the location of the information carrier, the indicia indicting the presence of the information carrier; the helmet having an exterior shell and an inner core received by the exterior shell; and wherein the information carrier is insertable into the helmet between the inner core and the exterior shell.

In general, in another aspect, the emergency information system for a helmet includes a helmet; an information carrier being removably insertable into the helmet, the information carrier containing emergency medical and contact information; and indicia on an exterior surface of the helmet approximate the location of the information carrier, the indicia indicating the presence of the information carrier; and wherein the information carrier is an electronic information carrier such as a flash-memory storage device or other type.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein.

The same reference numerals refer to the same parts throughout the various figures.

DETAILED DESCRIPTION OF THE INVENTION

Figure 1A:
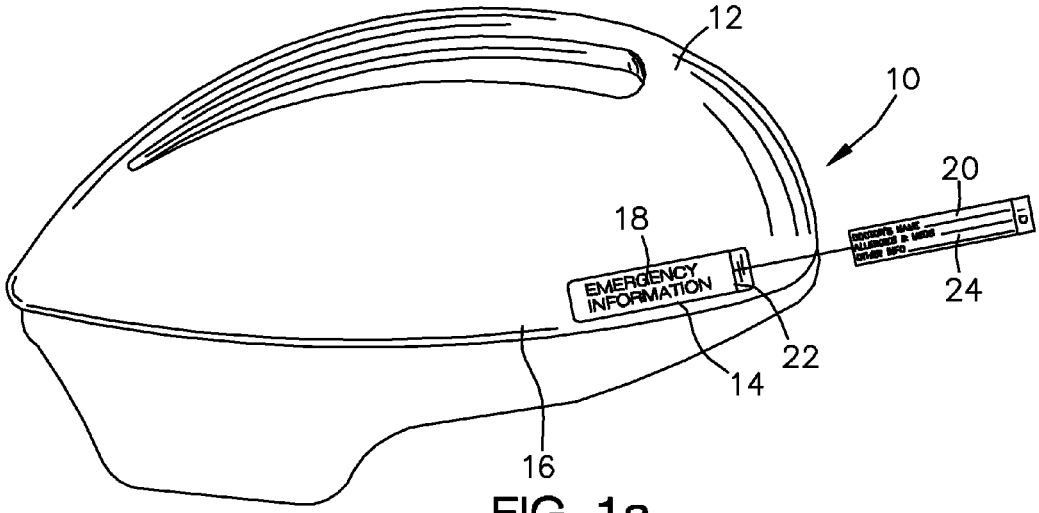
FIG. 1*a* is a diagrammatic first side view of a safety helmet having attached thereto an information carrier constructed in accordance with the principles of the present invention.

Referring now to the drawings, and particularly to FIGS. 1*a*, 1*b*, 1*c*, and 2, a preferred embodiment of the emergency information system of the present invention is shown and generally designated by the reference numeral 10.

The primary purpose of the emergency information system 10 is to provided emergency services with emergency contact and medical information in the event the user is involved in an accident.

In FIG. 1, there is shown a diagrammatic view of the emergency information system 10 in use with a typical safety helmet 12. The emergency information system 10 includes a carrier sleeve 14 shown attached to an exterior surface 16 of the safety helmet 12. The carrier sleeve 14 is preferably attached to the safety helmet 12 by an adhesive backing. However, other methods of attaching the carrier sleeve 14 can include mating fasteners, such as a hook and loop type fastener. The carrier sleeve 14 is constructed of a durable material such as but not limited to vinyl. Preferably, the carrier sleeve 14 is flexible to conform to the exterior shape of the safety helmet 12 to which it is attached. Further, the carrier sleeve 14 may be entirely light reflective or may include only select light reflecting portions. The carrier sleeve further can include indicia 18 on an outer surface and the indicia 18 may also be light reflective. The indicia 18 provides an indication of the presence and location of an information carrier 20.

Towards one end of the carrier sleeve 14 there is an carrier sleeve opening 22 which permits the removable insertion of the information carrier 20. In this particular example, the information carrier is an information card 24. The information card 24, shown removed from the information sleeve, is of a flexible, durable material that is preferably water-proof. The information card 24 is of dimensions allowing the card to be inserted into the carrier sleeve 14 through the carrier sleeve opening 22. Preferably, the information card 24 is a of a length permitting an end portion of the information card 24 to extend beyond the carrier sleeve opening 22, thereby providing a user grasping region.

Figure 1B:
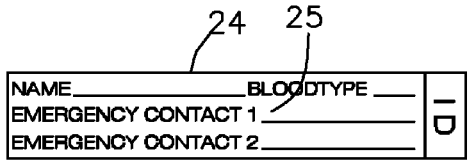
FIG. 1*b* is a front view of an example information carrier showing various types of information that may be carried by the information carrier.
Figure 1C:
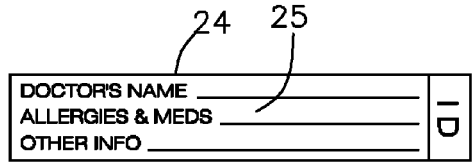
FIG. 1*c* is a view the opposite side of the example information carrier shown in FIG. 1*b*, which also illustrates additional types of information that may be carried by the information carrier.

With references to FIGS. 1*b* and 1*c*, which shows the front and back sides of the information card 24 and exemplary medical and emergency contact information 25. The medical and emergency information can include such information as the bear's names, blood type, doctor's name, medication, medical condition(s), emergency contact(s), date of birth, allergies, or any other information that might be vital to an emergency personnel.

Figure 2:
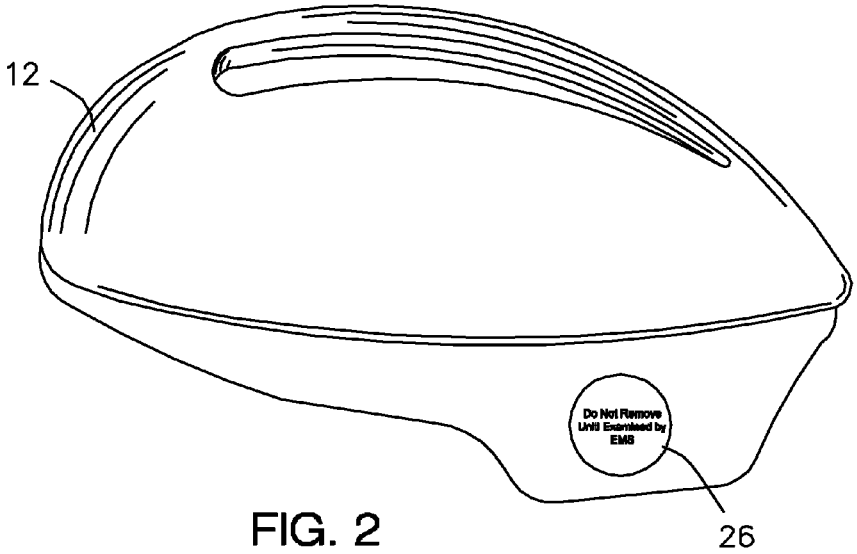
FIG. 2 is a diagrammatic second side view of the safety helmet shown in FIG. 1, which illustrates a warning decal that may include various warnings and/or instructions to bystanders and emergency and medical personnel.

Turning now to FIG. 2, which shows the opposite side of the safety helmet 12 shown in FIG. 1 having affixed thereto a decal 26. The decal 26 provides warning and instructional information relating to health of the wearer of the safety helmet 12 and provides notification of the presence of the emergency information system 10. An exemplary warning is illustrated on the decal 26, which includes the statement "Do not remove helmet until examined by EMS".

The decal 26 is shown in a preferred location on the safety helmet 12 which is the side opposite of the side bearing the information carrier 20. The preferred location ensures that first attenders or emergency personnel are made aware of the information carrier 20 in the event the side of the safety helmet 12 bearing the emergency card is not visible due to the positioning of the wearer of the safety helmet. The decal 26 may be entirely light reflective or may include only select light reflecting portions. Further, the indicia on the decal 26 may be light reflective. Moreover, the decal 26 is constructed of a durable and flexible material.

With reference now to FIG. 3-8, there is shown an alternate version of the emergency information system 10 which provides a safety helmet 12 including provisions permitting the information carrier 20 to be inserted into the safety helmet.

Figure 3:
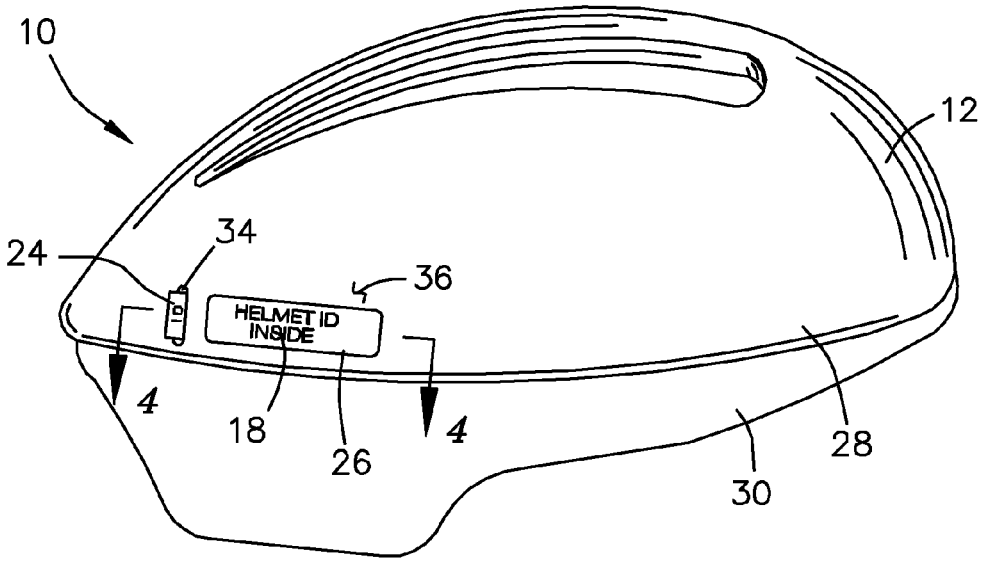
FIG. 3 is a diagrammatic first side view of a safety helmet having attached thereto an alternate information carrier, which is formed as an integral part of the safety helmet.
Figure 4:
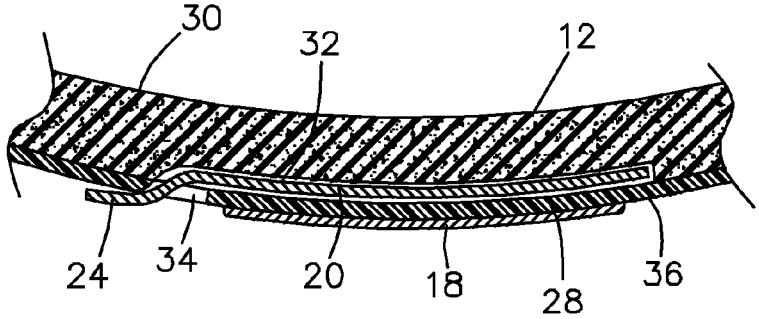
FIG. 4 is a cross sectional view taken along line 4*a*-4*a* in FIG. 3 showing a lateral cross section of the information carrier of FIG. 3 and how it is formed as an integral part of the safety helmet.

With particular reference to FIGS. 3 and 4, there is shown a safety helmet 12 including one exemplary provision permitting the information carrier 20 to be inserted into the safety helmet. In the example, the safety helmet 12 includes an exterior shell 28 and an inner core 30 inserted into the exterior shell. The exterior shell 28 may entirely cover the inner core 30 or may leave the inner core partially exposed. As shown, the information carrier 20 in the form of the information card 24, as described above, is inserted into the safety helmet 12 at a location that is between the inner core 30 and the exterior shell 28. The inner core 30 can include a recessed section 32 for receiving the information card 24 therein. The exterior shell 28 includes a slot 34 through which the information card 24 passed through to be inserted between the inner core 30 and the exterior shell. Preferably, the information card 24 is of length permitting an end to extend beyond the slot 34, thereby providing a user grasping region.

On a surface 36 of the exterior shell 28 approximate the location of the information card 24 there is indicia 18 provided which includes information indicating the location of the information card. The indicia 18 may also include warning or instructional information in addition to or in place of the information indicating the location of the information card 24. The indicia 18 can be in the form of a decal as shown or could be directly printed on the surface 36 of the exterior shell 28. The indicia 18 and decal 26 may be light reflective.

Figure 5:
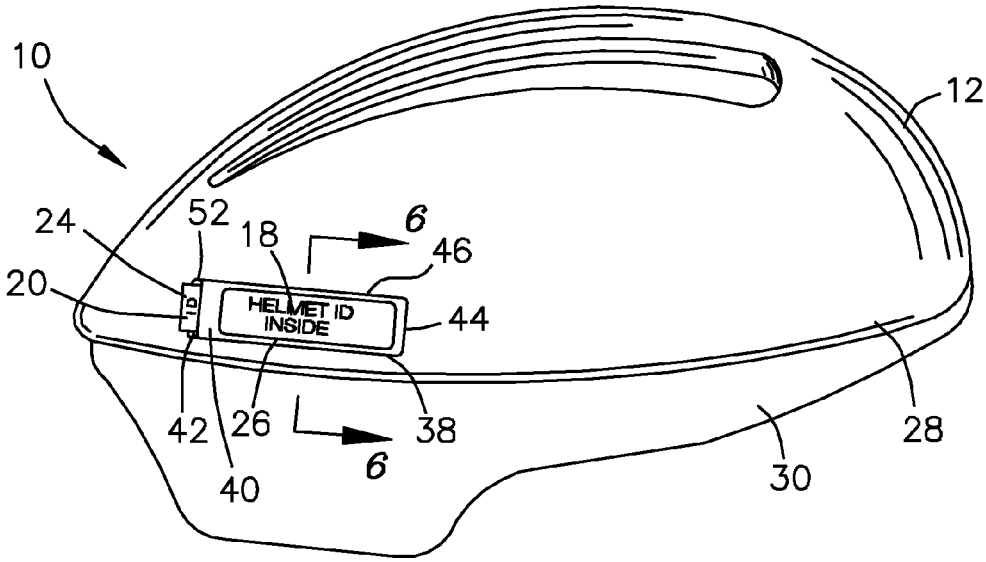
FIG. 5 is a diagrammatic first side view of a safety helmet having attached thereto an alternate information carrier, which is formed as part of the safety helmet.
Figure 6:
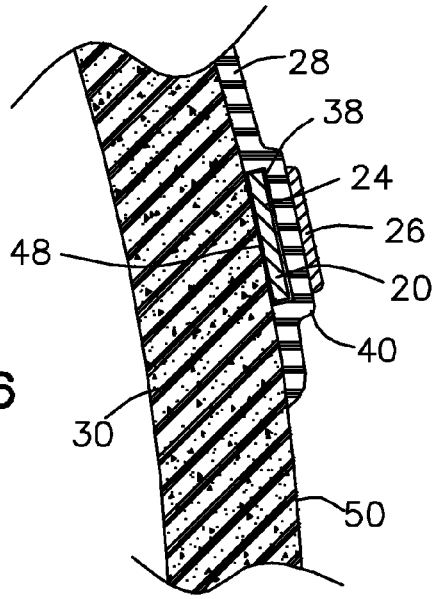
FIG. 6 is a cross sectional view taken along line 6-6 in FIG. 5 showing a transverse cross section of a second alternate information carrier and how it is formed in to the safety helmet.

With particular reference now to FIGS. 5-6, there is shown a safety helmet 12 including a second exemplary provision permitting the information carrier 20 to be inserted into the safety helmet. In this example, the safety helmet 12 is provided with a compartment 38 for removably receiving the information carrier 20, shown as an information card 24. A first side wall 40 and two opposed end walls 42 and 44 of the compartment 38 are defined by a surface area 46 of the exterior shell 28 being outwardly protruded and a second side wall 48 being defined by an outward surface 50 of the inner core 30. An opening 52 is provided through one end wall permitting the insertion of the information card 24 into and out of the compartment 38.

As in the previous example, preferably, the information card 24 is of length permitting an end to extend beyond the slot 34, thereby providing a user grasping region. Further, as in the previous example, on a surface 36 of the exterior shell 28 approximate the location of the information card 24 there is indicia 18 provided which includes information indicating the location of the information card. The indicia 18 may also include waning or instructional information in addition to or in place of the information indicating the location of the information card 24. The indicia 18 can be in the form of a decal as shown or could be directly printed on the surface 36 of the exterior shell 28. The indicia 18 and decal 26 may be light reflective.

Figure 7:
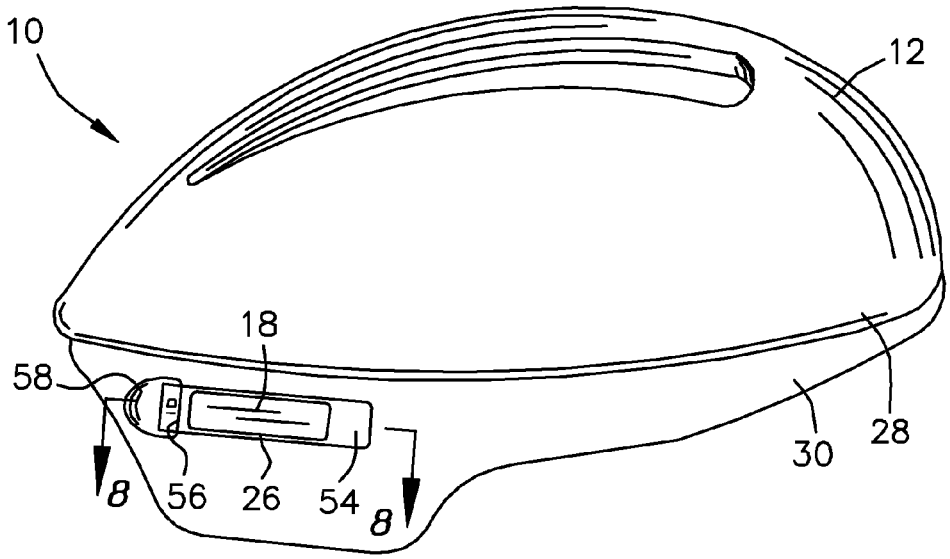
FIG. 7 is a diagrammatic first side view of a safety helmet having attached thereto an additional alternate information carrier, which is formed as part of the safety helmet.
Figure 8:
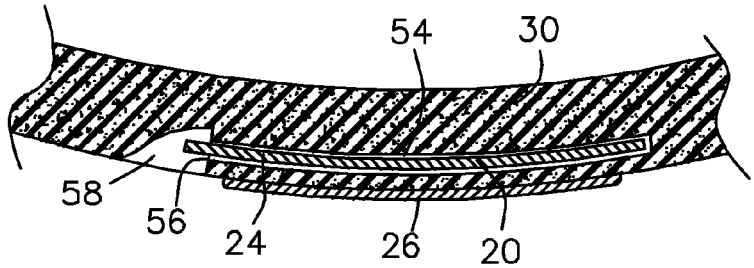
FIG. 8 is a cross sectional view taken along line 8-8 in FIG. 7 showing a lateral cross section of the information carrier of FIG. 5 and how it is formed as part of the safety helmet.

With attention now to FIGS. 7 and 8, there is shown a safety helmet 12 including a third exemplary provision permitting the information carrier 20 to be inserted into the safety helmet. In this example, the inner core 30 is formed with an integral pocket 54 having an open end 56 for removably receiving the information carrier 20, shown as an information card 24. Preferably, the pocket 54 is formed within the inner core 30 at a location where the inner core is not covered by the exterior shell 28. At the open end 56 there can be a finger recess 58 allowing a user to more easily grasp the information card 24.

As in the previous two examples, preferably, the information card 24 is of length permitting an end to extend beyond the slot 34, thereby providing a user grasping region. Further, as in the previous example, on a surface 36 of the exterior shell 28 approximate the location of the information card 24 there is indicia 18 provided which includes information indicating the location of the information card. The indicia 18 may also include warning or instructional information in addition to or in place of the information indicating the location of the information card 24. The indicia 18 can be in the form of a decal 26 as shown or could be directly printed on the surface 36 of the exterior shell 28. The indicia 18 and decal 26 may be light reflective.

Figure 9:
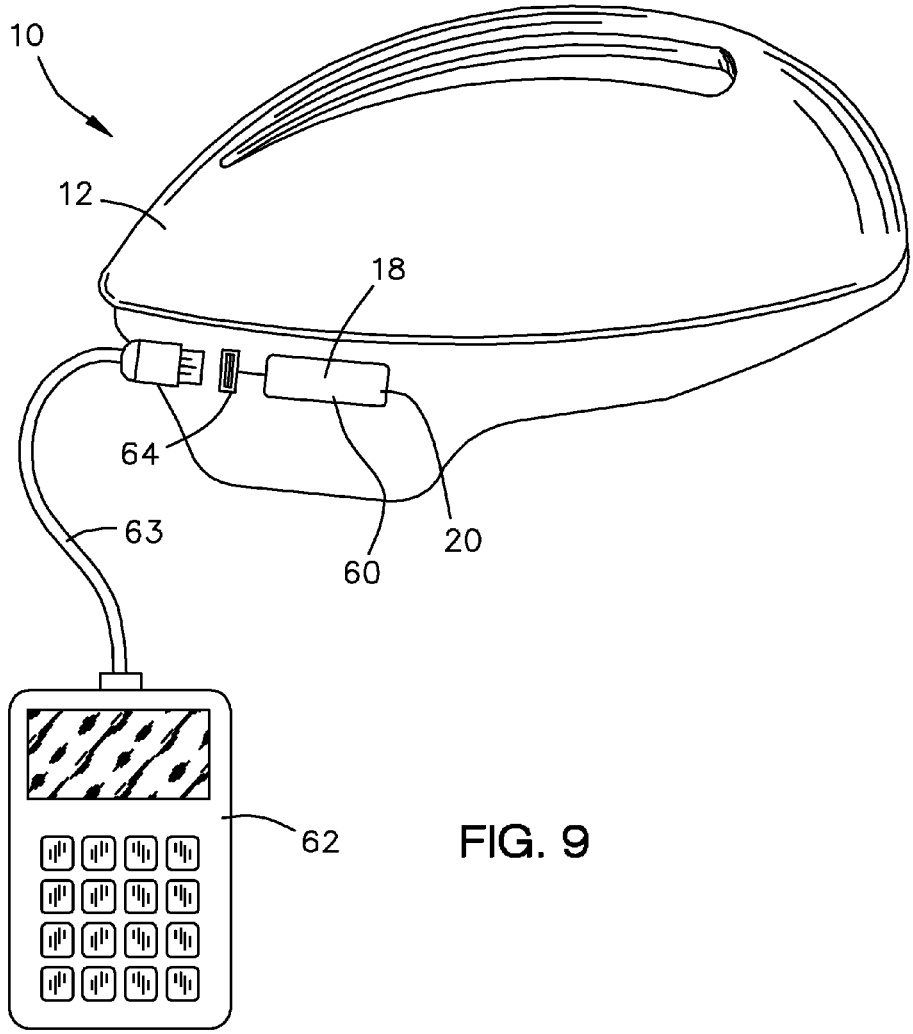
FIG. 9 is a diagrammatic view of a safety helmet having attached thereto an yet additional alternate information carrier comprising an electronic information carrier, such as flash-memory type carrier or other similar device and a computing system connected to the information carrier.

With reference now to FIG. 9, an alternate version of the emergency information system 10 is shown. In this version, the information carrier 20 is an electronic information carrier 60, such as but not limited to a flash memory card, a memory stick, optical media or other such electronic information carrier. The information carrier 20 can be made integral and non-removable from the safety helmet 12 or can be removable using any one of the previous examples or in any other fashion. The electronic information carrier 60 will carry the same or similar information as carrier 20 in the above described information carrier and information card 24. A computing system 62 either portable or at a fix location is operably interfacable to the electronic information carrier 60 to either read information from it or to write information to it. In one preferred application, the computing system 62 is portable, and can be interfaced with the electronic information 60 carrier directly through cabling 63 or through a coupling port 64. The computing system 62 could also be interfaced with the electronic information carrier 60 through other data transfer, such as but not limited to infra red, RF, or other wireless means. A water tight seal, such as a plug insertable into the coupling port 64 could also be provided. The electronic information carrier 60 could also be fitted with a global positioning system of the type well known in the art that are used with various portable electronic devices. A location transponder could also be included to help locate the wearer in an avalanche situation.

A number of embodiments of the present invention have been described. Nevertheless, it will be understood that various modifications may be made without departing from the spirit and scope of the invention. Accordingly, other embodiments are within the scope of the following claims.

We claim:

1. An emergency information system comprising:

a helmet;

information carrier being removably insertable into said helmet, said information carrier containing emergency medical and contact information; and indicia on an exterior surface of said helmet approximate the location of said information carrier, said indicia indicting the presence of said information carrier, wherein said information carrier is an information card having an end portion that extends beyond a surface of said helmet such that said end portion is graspable in order to be removed from and reinserted into said helmet, said helmet includes an exterior shell and an inner core received by said shell, said inner core including a section thereof which is not covered by said shell, wherein said section defines a pocket having an opened end for removably receiving said information card therein.

* * * * *